US011839318B1

(12) United States Patent
Gatlin, Sr. et al.

(10) Patent No.: US 11,839,318 B1
(45) Date of Patent: Dec. 12, 2023

(54) FOAM CUP HOLDER

(71) Applicants: Randy Gatlin, Sr., Denison, TX (US); Marilyn Gatlin, Denison, TX (US)

(72) Inventors: Randy Gatlin, Sr., Denison, TX (US); Marilyn Gatlin, Denison, TX (US)

( * ) Notice: Subject to any disclaimer, the term of this patent is extended or adjusted under 35 U.S.C. 154(b) by 0 days.

(21) Appl. No.: 17/841,381

(22) Filed: Jun. 15, 2022

(51) Int. Cl.
*A47G 23/02* (2006.01)
*B65D 25/28* (2006.01)

(52) U.S. Cl.
CPC ..... *A47G 23/0216* (2013.01); *B65D 25/2811* (2013.01); *B65D 25/2817* (2013.01); *B65D 2525/285* (2013.01)

(58) Field of Classification Search
CPC ..... A47G 23/0216
USPC ..... 220/741; 215/396
See application file for complete search history.

(56) References Cited

U.S. PATENT DOCUMENTS 3,116,947 A * 1/1964 Brownrigg ..... A45F 5/10 294/157
4,898,297 A 2/1990 Wheeler
4,966,303 A 10/1990 Jones
D478,007 S 8/2003 Hayer
6,978,888 B1 12/2005 Sanders
7,207,538 B2 4/2007 Kent-Fawkes
D544,760 S 6/2007 Croteau et al.
7,909,202 B1 3/2011 Gordon
8,899,644 B2 * 12/2014 Hancey ..... A45F 5/10 294/157
D786,628 S 5/2017 Chisholm
10,278,527 B2 5/2019 Hayward
2015/0108150 A1 * 4/2015 Garcia ..... A47G 23/0216 220/735
2015/0164256 A1 * 6/2015 Helton ..... A47G 23/0216 220/738
2018/0134493 A1 * 5/2018 Cunningham ..... A47G 23/0216
2019/0328164 A1 * 10/2019 Bauer ..... A47G 23/0216

* cited by examiner

*Primary Examiner* — Mollie Impink
(74) *Attorney, Agent, or Firm* — CRAMER PATENT & DESIGN, PLLC; Aaron R. Cramer

(57) ABSTRACT

A Styrofoam® Cup Holder is a cup holding device capable of being removably secured about a traditionally sized Styrofoam® cup. The device has an upper and lower band secured vertically to each other by at least one vertical band. The interior of each band has a gripping texture to slightly pierce the exterior cup surface without causing a leak. A single exterior cup handle is vertically secured to each band.

1 Claim, 3 Drawing Sheets

FOAM CUP HOLDER

RELATED APPLICATIONS

None.

FIELD OF THE INVENTION

The present invention relates generally to cup holder and more specifically to foam or Styrofoam® cup holder.

BACKGROUND OF THE INVENTION

Whether traveling on the road or for the mere convenience of home living, people around the world often use a Styrofoam® or foam cup to consume coffee or other hot beverages. While Styrofoam® or foam cups offer many advantages such as superior insulating properties, affordability and disposability—they do have some shortcomings.

Apart from being fragile and easily punctured, Styrofoam® or foam cups almost always lack a handle. This drawback can make it difficult to properly utilize the cup when driving or engaging in any other activity while drinking from the cup. A need therefore exists for a device which provides a reusable handle which removably and securely fits about any given Styrofoam® or foam cup. The Styrofoam® or foam cup holder provides a solution to the aforementioned problems in a manner that is easy, affective, and affordable.

SUMMARY OF THE INVENTION

To achieve the above and other objectives, the present invention provides for a cup holder device which has a cup having a base, a side wall, and an opening, the cup containing a beverage, and a plurality of circular portions which are configured to extend about a periphery of the side wall of the cup. The circular portions are in alignment such that the cup passes through the circular portions.

The cup may be from a takeout facility. The cup may be flimsy and easily collapsible or broken thereby causing the sides to collapse while being held and the contents of cup being spilled. The cup may be tapered. The circular portions may include a pair of rings. The circular portions may include a friction fit with the side wall. The circular portions may include a pressure fit with the side wall. The circular portions may include a shape selected from the group consisting of an oval shape, an oblong shape, a triangular shape, a rectangular shape, a square shape, a polygonal shape, an irregular shape, a uniform shape, a non-uniform shape, a variable shape, or a tapered shape. The circular portions may each have a different width.

The circular portions may each have a width of 1½ in. The cup holder device may also have circular portions to form a sleeve and provide support at two locations along the cup. The circular portions may be configured and oriented to hold and distribute an equal amount of pressure at various locations of the cup to resist and/or prevent the cup from collapsing or breaking. The circular portions may be each two inches apart. The cup holder device may further comprise an extension. The extension may be a handle. The handle may be connected with a first ring and a second ring and may form a handle opening configured for disposal of a hand or fingers of a user. The handle may allow the user to grasp the handle rather than grasping the cup to avoid applying too much pressure to the cup and causing damage to the cup. The handle may extend in the range of 2 to 2½ inches.

The handle may include a shape selected from the group consisting of an ergonomic shape, an oval shape, an oblong shape, a triangular shape, a rectangular shape, a square shape, a polygonal shape, an irregular shape, a uniform shape, a non-uniform shape, a variable shape, or a tapered shape. The handle may be connected with the circular portions rings via a connection selected from the group consisting of a friction fit connection, a pressure fit connection, a mating engagement connection, a dovetail connection, a tongue in groove connection, or a key/key slot connection.

BRIEF DESCRIPTION OF THE DRAWINGS

These and other features, aspects, and advantages of the present disclosure will become better understood with regard to the following description, appended claims, and accompanying drawings where:

Figure 1:
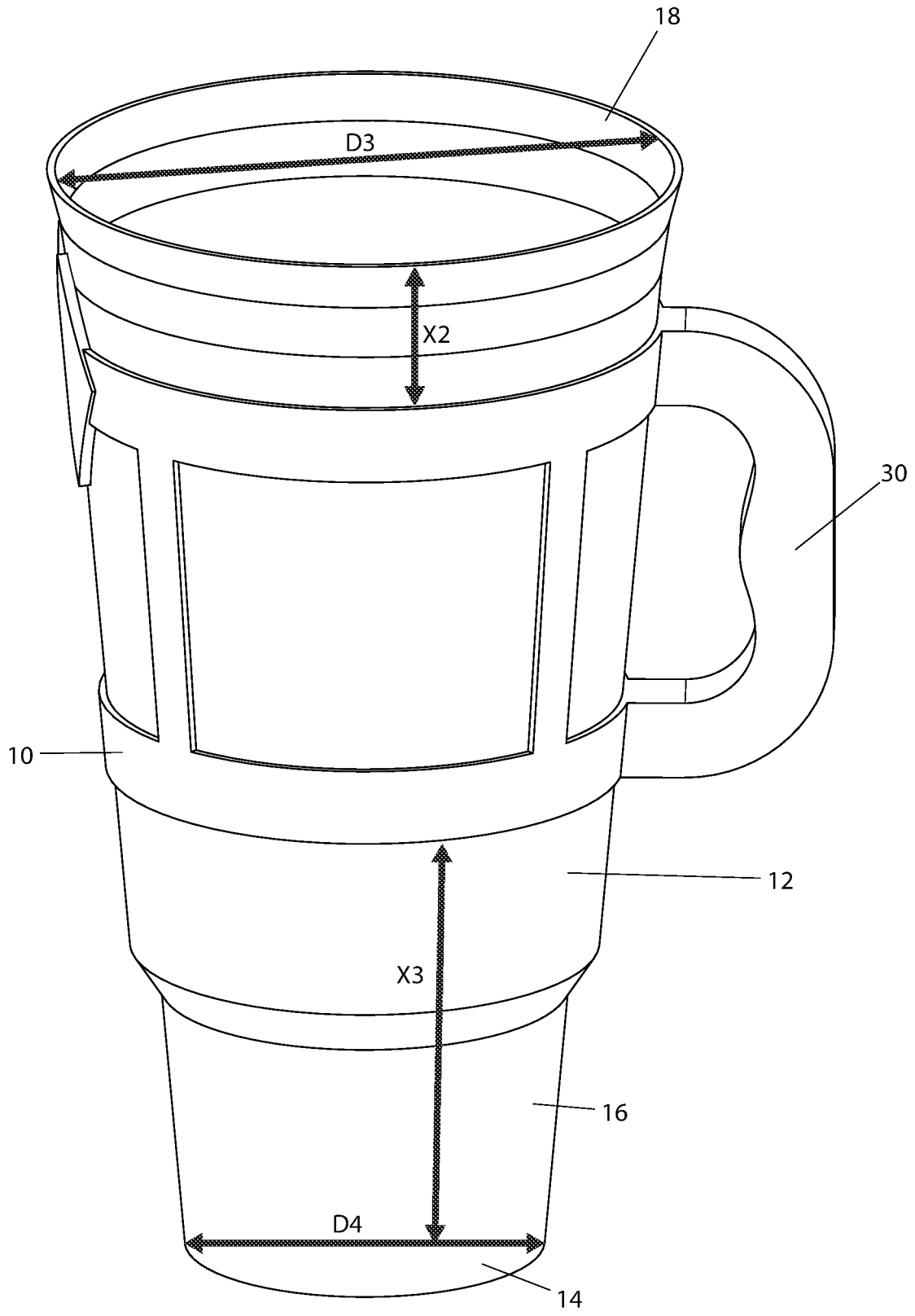
FIG. 1 is a perspective view of a cup holder device, according to an embodiment of this disclosure.

| DESCRIPTIVE KEY | |
|---|---|
| 10 | cup holder device |
| 12 | cup |
| 14 | base |
| 16 | side wall |
| 18 | opening |
| 20 | first ring |
| 20a | second ring |
| 22 | tubular section |
| 30 | handle |
| 32 | handle opening |
| 40 | surface |
| W | width |
| D1 | diameter of first ring 20 |
| D2 | diameter of second ring 20a |
| D3 | diameter of opening 18 |
| D4 | diameter of base 14 |
| X | distance between rings 20, 20a |
| X2 | distance between first ring 20 and opening 18 |
| X3 | distance between second ring 20a and base 14 |
| X4 | distance of handle |

DETAILED DESCRIPTION

The following disclosure is provided to describe various embodiments of a cup holder device 10. The cup holder device 10 can be utilized on cups 12 from various takeout locations, for example, Styrofoam® or foam cups. Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one or more element in that group, which may be included with other elements of the group. All numbers, measurements, and values are given as approximations unless expressly stated otherwise.

Various aspects of the present disclosure will now be described in detail, without limitation. Skilled readers should not view the inclusion of any alternative labels as limiting in any way. Referring now to FIGS. 1-5, an illustrative is a cup holder device 10 will now be discussed in more detail.

In some embodiments, a cup 12 is provided with a beverage from a takeout facility. Cup 12 may either be hot to the touch or may be flimsy and easily collapsible or broken thereby causing the sides to collapse while being held and the contents of cup 12 being spilled. Cup 12 includes a base 14, a side wall 16 and an opening 18.

Figure 2:
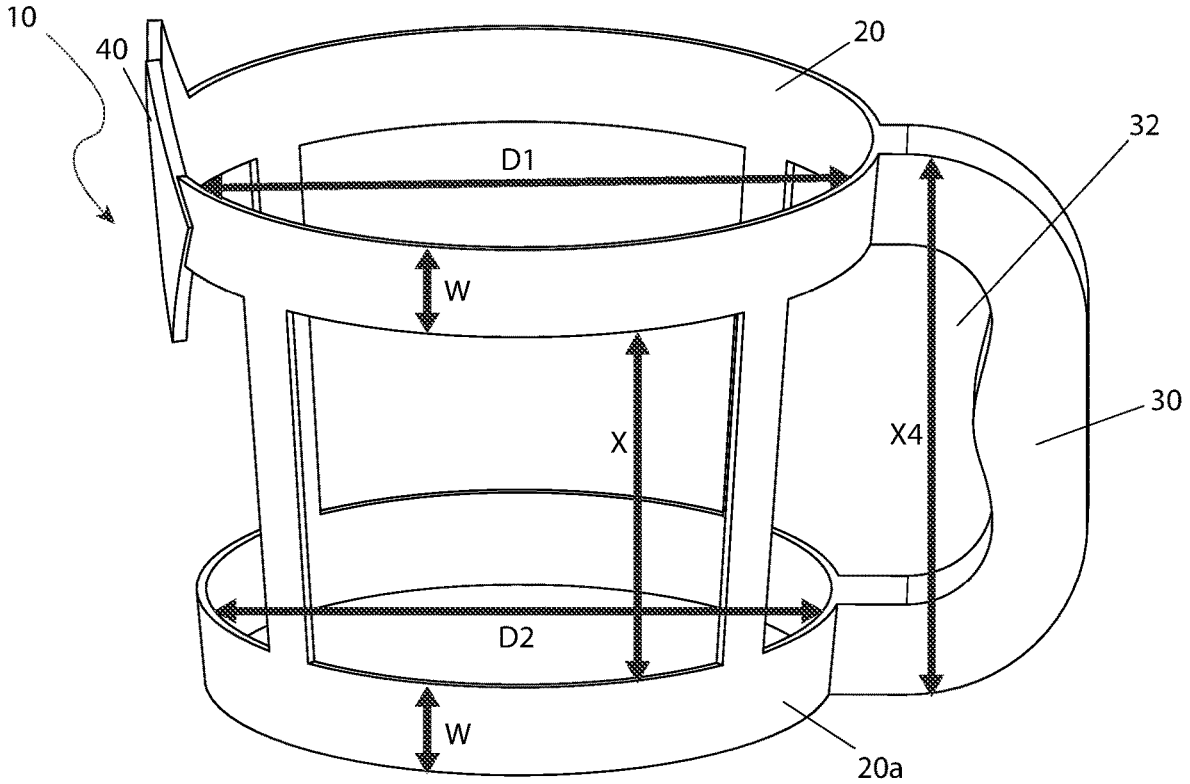
FIG. 2 is a perspective view of the cup holder device, according to an embodiment of this disclosure.

Cup holder device 10 includes at least one (1) circular portion, for example, a first ring 20. In some embodiments, cup holder device 10 includes two (2) rings 20, 20*a*. Rings 20, 20*a* are configured to extend about a periphery of side wall 16, as shown in FIG. 1. In some embodiments, rings 20, 20*a* include a width W, as shown in FIG. 2. In some embodiments, width W is approximately one and one-half inches (1½ in.). Rings 20, 20*a* are oriented in alignment such that cup 12 can pass through both rings 20, 20*a* for attachment of cup holder device 10.

Figure 3:
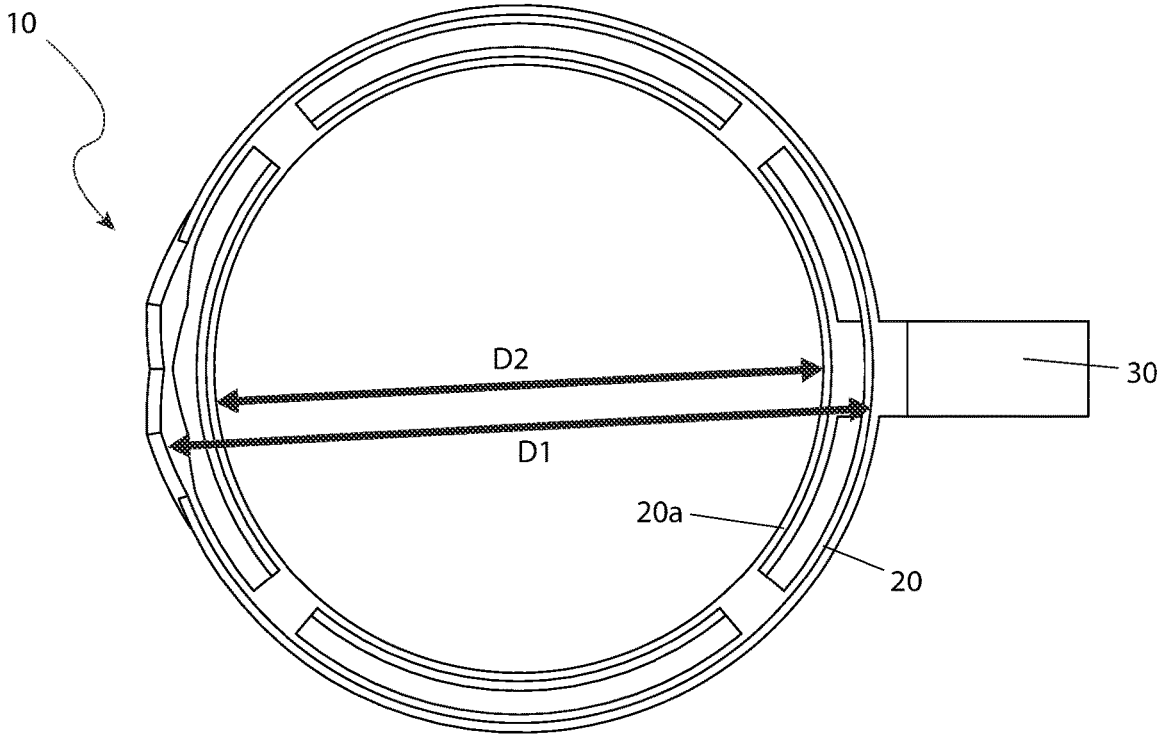
FIG. 3 is a top view of the cup holder device, according to an embodiment of this disclosure.
Figure 4:
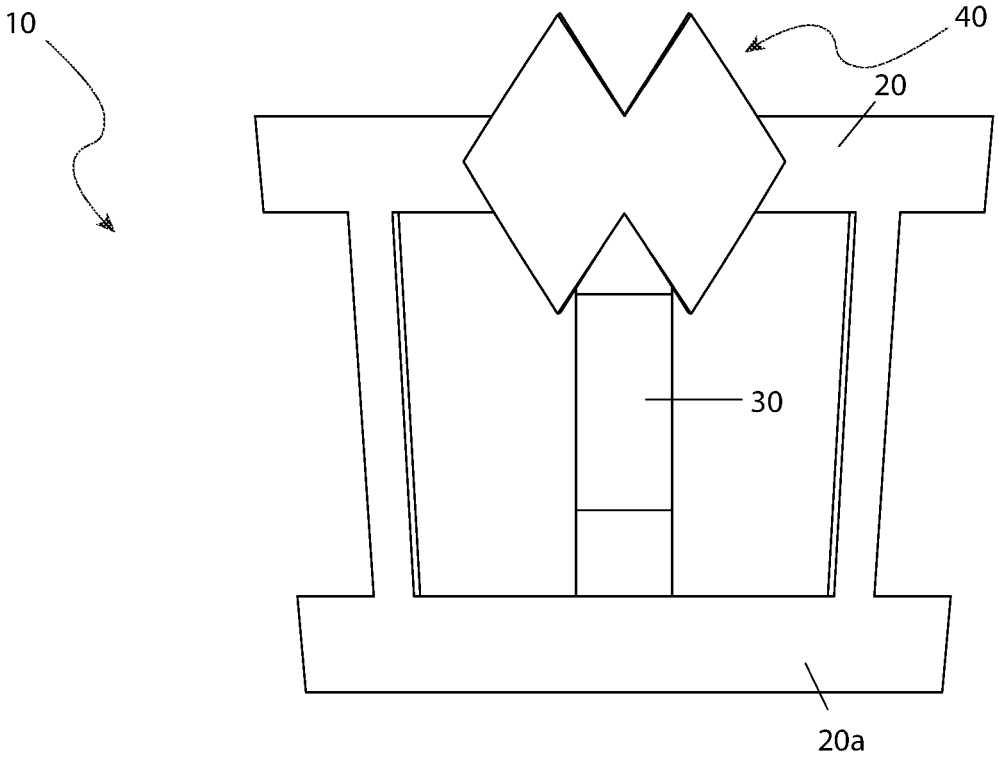
FIG. 4 is a side view of the cup holder device, according to an embodiment of this disclosure.
Figure 5:
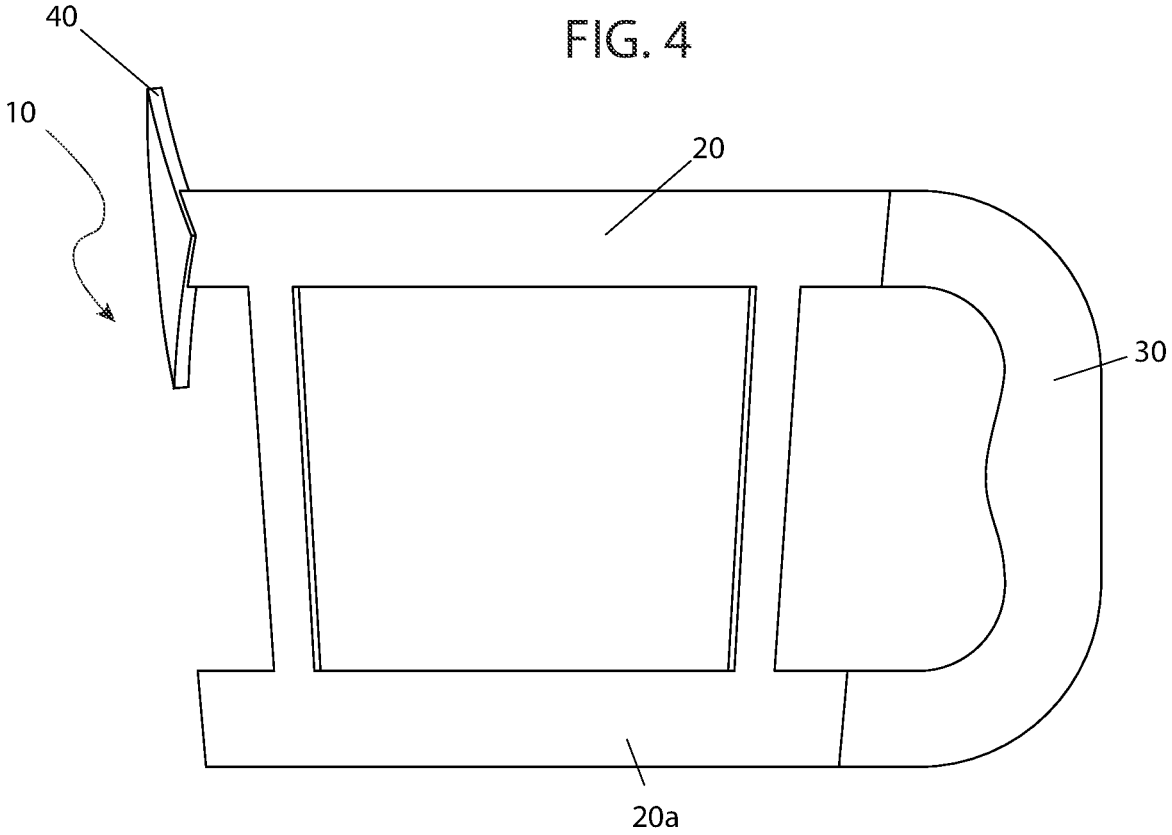
FIG. 5 is a side view of the cup holder device, according to an embodiment of this disclosure.

Rings 20, 20*a* are circular. In some embodiments, cup 12 includes a tapered configuration such that first ring 20 may include a diameter D1 larger than a diameter D2 of second ring 20*a*, as shown in FIG. 3. For example, cup 12 may include an opening 18 having a diameter D3 of approximately four and one-sixth inches (4⅙ in.) and base 14 may include a diameter D4 of approximately three and five-sixteenths inches (3 5/16 in.) inches. In this case, diameter D1 and diameter D2 will be in a range between approximately three and five-sixteenths and four and one-sixth inches (3 5/16-4⅙ in.). In some embodiments, rings 20, 20*a* are configured to form a friction fit and/or a pressure fit with a surface of wall 16. In some embodiments, rings 20, 20*a* may include various shapes, for example, oval, oblong, triangular, rectangular, square, polygonal, irregular, uniform, non-uniform, variable, and/or tapered to conform to a shape of various cups 12.

Rings 20, 20*a* are spaced apart a distance X to form a sleeve and provide support at two (2) locations along cup 12. In some embodiments, distance X is approximately two inches (2 in.). In some embodiments, first ring 20 is oriented a distance X2 from opening 18. In some embodiments, distance X2 is approximately one inch (1 on.) from opening 18. In some embodiments, second ring 20*a* is oriented a distance X3 from base 14. In some embodiments, distance X3 is approximately one-half inch (½ in.) from base 14. Rings 20, 20*a* are configured and oriented to hold and distribute an equal amount of pressure at various locations of cup 12 to resist and/or prevent cup 12 from collapsing or breaking.

In some embodiments, cup holder device 10 includes an extension, for example, a handle 30. Handle 30 is connected with first ring 20 and second ring 20*a* and forms a handle opening 32. Handle opening 32 is configured for disposal of a hand and or fingers of a user.

In some embodiments, handle 30 extends a distance X4 along cup 12. In some embodiments, distance X4 is approximately two to two and one-half inches (2-2½ in.). In some embodiments, handle 30 may include various shapes, for example, ergonomically shaped, oval, oblong, triangular, rectangular, square, polygonal, irregular, uniform, non-uniform, variable, and/or tapered. Handle 30 allows the user to grasp handle 30 rather than grasping cup 12 to avoid applying too much pressure to cup 12 and causing damage to cup 12. In some embodiments, handle 30 may be integrally connected with rings 20, 20*a* or connected via a friction fit, pressure fit, mating engagement, dovetail connection, tongue in groove, and/or key/key slot.

In operation, a user will receive cup 12 from a takeout facility. The user will position cup 12 such that base 14 is above first ring 20. Base 14 is inserted into first ring 20 and holder 10 is translated along walls 16 until first ring 20 and second ring 20*a* fit snugly about cup 12. The user will insert their hand through handle 30 to avid applying any force to side wall 16 of cup 12 thereby resisting and/or preventing cup 12 from being damaged.

In some embodiments, cup holder device 10 may include a surface 40 configured for disposal of a company logo or name. In some embodiments, cup holder device 10 can be made from many materials including plastic or paper.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

What is claimed is:

1. A cup and a cup holder device, consisting of:

the cup having a base, a side wall, and an opening, the cup containing a beverage;

the cup holder device having a plurality of circular portions configured to extend about a periphery of the side wall of the cup, the circular portions are in alignment such that the cup passes through the circular portions and, an extension; and, wherein the cup is tapered;

wherein the circular portions include a pair of rings;

wherein the circular portions engage with the side wall in a friction fit;

wherein the circular portions each have a different maximum diameter;

wherein each ring has a width of 1 inch;

wherein the circular portions are configured and oriented to hold and distribute an equal amount of pressure at various locations of the cup to resist and/or prevent the cup from collapsing or breaking:

wherein the circular portions are each two inches apart;

wherein the extension is a handle;

wherein the handle is connected with each ring and forms a handle opening configured for disposal of a hand or fingers of a user;

wherein the handle allows the user to grasp the handle rather than grasping the cup to avoid applying too much pressure to the cup and causing damage to the cup; and, wherein the handle extends away from the cup in the range of 2 to 2.5 inches.

* * * * *